US010294696B2

(12) United States Patent
Zheng et al.

(10) Patent No.: US 10,294,696 B2
(45) **Date of Patent: *May 21, 2019**

(54) LOCKING MECHANISM FOR A TANK BODY AND A TANK COVER OF A PRESSURE TANK

(71) Applicant: Amsted Rail Company, Inc., Chicago, IL (US)

(72) Inventors: Yuepeng Zheng, Xinyang (CN); Yue Zuo, Chicago, IL (US); Rizhuo Bai, Datong (CN); Sijin Zhang, Xinyang (CN); Chengqun Yan, Xinyang (CN); Zhongxian Du, Xinyang (CN); Jianfei Sun, Harbin (CN); Fuyang Cao, Harbin (CN); Dongye Yang, Harbin (CN)

(73) Assignee: Amsted Rail Company, Inc., Chicago, IL (US)

( * ) Notice: Subject to any disclaimer, the term of this patent is extended or adjusted under 35 U.S.C. 154(b) by 105 days.

This patent is subject to a terminal disclaimer.

(21) Appl. No.: 15/407,009

(22) Filed: Jan. 16, 2017

(65) Prior Publication Data

US 2017/0268257 A1 Sep. 21, 2017

(30) Foreign Application Priority Data

Jan. 10, 2016 (CN) ..... 2016 2 0028485 U

(51) Int. Cl.

| | |
|---|---|
| ***E05B 51/02*** | (2006.01) |
| ***E05B 65/00*** | (2006.01) |
| ***E05C 9/18*** | (2006.01) |
| ***F17C 1/02*** | (2006.01) |
| ***F17C 13/08*** | (2006.01) |

(52) U.S. Cl.

CPC ..... *E05B 51/02* (2013.01); *E05B 65/006* (2013.01); *E05C 9/1808* (2013.01); *F17C 1/02* (2013.01); *F17C 13/08* (2013.01); *F17C 2201/0109* (2013.01); *F17C 2203/011* (2013.01); *F17C 2203/0639* (2013.01); *F17C 2205/01* (2013.01); *F17C 2260/01* (2013.01)

(58) Field of Classification Search

CPC ..... F17C 13/08; B22D 17/32; B22D 37/00; B22D 39/00; B22D 41/04; B22D 41/06; B22D 17/2015; B22D 13/107

USPC ..... 220/319

See application file for complete search history.

(56) References Cited

U.S. PATENT DOCUMENTS 4,324,392 A * 4/1982 White ..... B22D 41/04 164/337

4,986,517 A * 1/1991 Ford ..... B22D 39/00 222/593

(Continued)

OTHER PUBLICATIONS

U.S. Appl. No. 15/406,990, filed Jan. 16, 2017, Sijin Zhang, et al.

(Continued)

*Primary Examiner* — Shawn M Braden

(74) *Attorney, Agent, or Firm* — Harness, Dickey & Pierce, P.L.C.

(57) ABSTRACT

A locking mechanism for a tank body and a tank cover of a pressure tank. The locking mechanism includes: a tank body, a tank chamber, a tank cover, a hydraulic cylinder, a locking ring, a spring cylinder, a fixing supporting mechanism, a fixing plate, a barb, a notch, and a pulling cylinder.

5 Claims, 1 Drawing Sheet

(56) References Cited

U.S. PATENT DOCUMENTS

Figure 1:
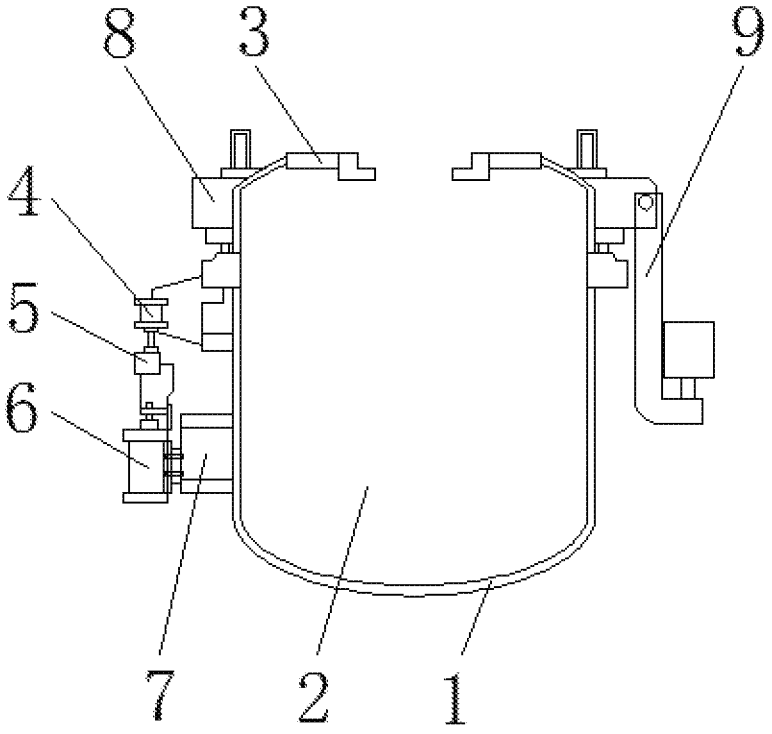

| | | | | |
|---|---|---|---|---|
| 8,875,960 | B2 * | 11/2014 | Terashima | B22D 37/00 164/335 |
| 2001/0052662 | A1 * | 12/2001 | Mortari | B22D 2/00 266/80 |
| 2009/0230159 | A1 * | 9/2009 | Fleischanderl | B22D 37/00 222/590 |

OTHER PUBLICATIONS

U.S. Appl. No. 15/407,000, filed Jan. 16, 2017, Zhaoli Yang, et al.
U.S. Appl. No. 15/407,013, filed Jan. 16, 2017, Zhongxian Du, et al.

* cited by examiner

LOCKING MECHANISM FOR A TANK BODY AND A TANK COVER OF A PRESSURE TANK

CROSS-REFERENCE TO RELATED APPLICATION

This application claims the benefit and priority of Chinese Patent Application Serial No. 201620028485.X filed Jan. 10, 2016, the entire disclosure of which is incorporated herein by reference.

FIELD

The present invention relates to the technical field of locking of pressure tanks, and specifically to a locking mechanism for a tank body and a tank cover of a pressure tank.

BACKGROUND

This section provides background information related to the present disclosure which is not necessarily prior art.

Currently in China, cast steel wheels or even all the cast steel products (especially large cast pieces) are generally produced by gravity pouring process, rather than pressure pouring process.

SUMMARY

This section provides a general summary of the disclosure, and is not a comprehensive disclosure of its full scope or all of its features.

In order to improve product quality, the Applicant intends to use pressure pouring technology to produce cast steel wheels, and one of the key issues for it is to solve the problem of locking of the pressure tank in pressure pouring. The current pressure pouring technology is mainly used in the field of injection casting, aluminum casting and copper casting, etc. in which a relatively low pouring temperature is applied and thus the liquid to be poured has a relatively slight influence on the pressure tank. Besides, there are various locking manners between the tank body and the tank cover of the pressure tank, but none of them is suitable for the requirements of the equipment for successive production of cast steel wheels.

The objective of the present invention is to provide a locking mechanism for a tank body and a tank cover of a pressure tank, so as to solve the problem(s) as mentioned in the above background technology.

In order to achieve the above objective, a technical solution is provided in the present invention as follows: a locking mechanism for a tank body and a tank cover of a pressure tank, comprising: a tank body, a tank chamber, a tank cover, a hydraulic cylinder, a locking ring, a spring cylinder, a fixing supporting mechanism, a fixing plate, a barb, a notch, and a pulling cylinder, wherein the tank chamber is in the tank body, the tank body is provided thereon with the tank cover and is provided on its left side with the hydraulic cylinder, the hydraulic cylinder is provided on its lower side with the locking ring, the locking ring is provided on its lower side with the spring cylinder, the spring cylinder is provided on its right side with the fixing supporting mechanism, the tank body is provided thereon with the fixing plate, the fixing plate is provided on its lower side with the barb, the locking ring is provided on its lower side with the notch, the spring cylinder is provided at its vicinity with the pulling cylinder.

Preferably, eight barbs are distributed uniformly along a circumferential direction of the tank cover.

Preferably, three spring cylinders are distributed uniformly along a circumferential direction of the tank body.

Preferably, the spring cylinder supports one locking ring, and each of the spring cylinders is provided at its vicinity with one pulling cylinder.

Preferably, eight pressing hydraulic cylinders are distributed uniformly above the locking ring, and eight notches are distributed uniformly on the locking ring.

Compared with the prior art, the present invention may have the following beneficial effects: the structure is easy to be assembled and mounted and can be locked by a high external force, that is, the tank cover can be disassembled conveniently and it can be locked tightly by a sufficient external force, without any gas leakage, even if the tank cover is deformed and the package cover is slightly deformed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
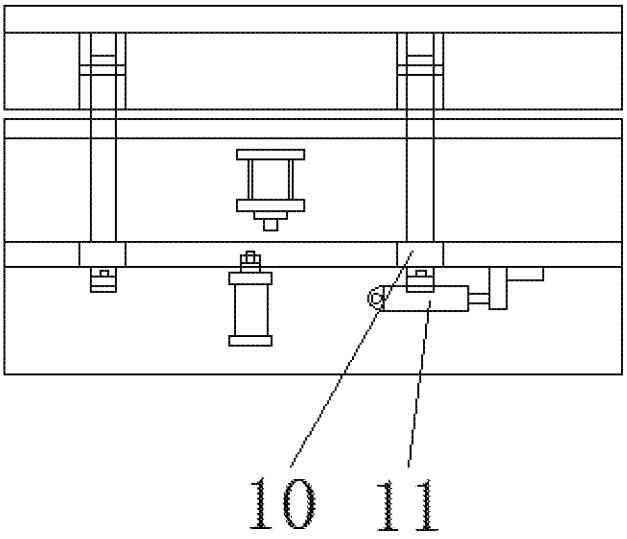

FIG. 1 is a front view of a tank body and a tank cover of a pressure tank having a locking mechanism according to an embodiment of the present invention; and FIG. 2 is an unwound diagram of a tank body and a tank cover of an embodiment of the present invention.

Corresponding reference numerals indicate corresponding parts throughout the several views of the drawings.

DETAILED DESCRIPTION

Example embodiments will now be described more fully with reference to the accompanying drawings.

Hereinafter, the technical solutions in the embodiments of the present invention will be described clearly and completely, in connection with the accompanying drawings in the embodiments of the present invention. The described embodiments are only example embodiments of the present invention, not all the possible embodiments. Any other embodiments obtained by those skilled in the art, based on the embodiment of the present invention and without any inventive work, will fall within the protection scope of the present invention.

Referring to FIGS. 1 and 2, in the present invention, a technical solution is described as follows: a locking mechanism for a tank body and a tank cover of a pressure tank, includes a tank body 1, a tank chamber 2, a tank cover 3, a hydraulic cylinder 4, a locking ring 5, a spring cylinder 6, a fixing supporting mechanism 7, a fixing plate 8, a barb 9, a notch 10, and a pulling cylinder 11. As shown in FIGS. 1 and 2 the tank chamber 2 is in the tank body 1, the tank body 1 is provided thereon with the tank cover 3, three spring cylinders 6 are distributed uniformly along a circumferential direction of the tank body 1 and eight barbs 9 are distributed uniformly along a circumferential direction of the tank cover 3. As shown in FIG. 1 the tank body 1 is provided on its left side with the hydraulic cylinder 4, the hydraulic cylinder 4 is provided on its lower side with the locking ring 5, eight pressing hydraulic cylinders 4 are distributed uniformly above the locking ring 5 and eight notches are distributed uniformly on the locking ring. The locking ring 5 is provided on its lower side with the spring cylinder 6, where the spring cylinder 6 supports one locking ring 5 and each of the spring cylinders 6 is provided at its vicinity with one pulling cylinder 11. The spring cylinder 6 is provided on its right side with the fixing supporting mechanism 7, the tank body 1 is provided thereon with the fixing plate 8, the fixing plate 8 is provided on its lower side with the barb 9, the locking ring 5 is provided on its lower side with the notch 10, and the spring cylinder 6 is provided at its vicinity with the pulling cylinder 11.

The working principle of the locking mechanism for a tank body and a tank cover of a pressure tank of the present invention is described below. For the mechanism, the tank cover 3 is hoisted by a hoisting apparatus onto the tank body 1. The eight barbs on the tank cover 3 are inserted into eight notches 10 on the locking ring 5. After the insertion, the locking ring 5 is rotated by about 10 cm with the action of three pulling cylinders 11. The barbs 9 pass by the notches 10 and hook the locking ring 5; at this time, the locking 5 supported by three spring cylinders 6 is separated from the locked barbs 9 by a gap. Eight hydraulic cylinders 4 press the locking ring 5 downwards. The spring cylinder 6 supporting the locking ring 5 is compressed. The locking ring 5 presses the eight barbs in position such that the tank cover 3 is locked tightly onto the tank body 1. After working, the hydraulic cylinder retracts, the locking ring 5 is lifted upwards by the spring cylinder 6, the locking ring 5 is slightly separated from the barb of the tank cover 3, the locking 5 moves back with the action of the pulling cylinder 11, the barbs 9 are aligned with the notches 10 of the locking ring 5, and the tank cover 3 can be hoisted, ready for the next working cycle.

The embodiments described as above are example embodiments of the present invention and are set forth only for illustration of the present invention, rather than making limitation to the present invention in any form. Any equivalent embodiment with a partial variation or modification, which does not depart from the technical feature contents of the present invention, made by those skilled in the art based on the technical contents disclosed in the present invention and without departing from the scope of the technical features as provided in the present invention, will fall within the scope of the technical features of the present invention.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A locking mechanism for a tank body and a tank cover of a pressure tank, comprising:

a tank body (1), a tank chamber (2), a tank cover (3), a hydraulic cylinder (4), a locking ring (5), a spring cylinder (6), a fixing supporting mechanism (7), a fixing plate (8), a barb (9), a notch (10), and a pulling cylinder (11);

wherein the tank chamber (2) is in the tank body (1), the tank body (1) is provided thereon with the tank cover (3) and is provided on its left side with the hydraulic cylinder (4), the hydraulic cylinder (4) is provided on its lower side with the locking ring (5), the locking ring (5) is provided on its lower side with the spring cylinder (6), the spring cylinder (6) is provided on its right side with the fixing supporting mechanism (7), the tank body (1) is provided thereon with the fixing plate (8), the fixing plate (8) is provided on its lower side with the barb (9), the locking ring (5) is provided on its lower side with the notch (10), and the spring cylinder (6) is provided at its vicinity with the pulling cylinder (11).

2. The locking mechanism for a tank body and a tank cover of a pressure tank according to claim 1, wherein eight barbs (9) are distributed uniformly along a circumferential direction of the tank cover (3).

3. The locking mechanism for a tank body and a tank cover of a pressure tank according to claim 1, wherein three spring cylinders (6) are distributed uniformly along a circumferential direction of the tank body (1).

4. The locking mechanism for a tank body and a tank cover of a pressure tank according to claim 2, wherein the spring cylinder (6) supports one locking ring (5), and each of the spring cylinders (6) is provided at its vicinity with one pulling cylinder (11).

5. The locking mechanism for a tank body and a tank cover of a pressure tank according to claim 2, wherein eight pressing hydraulic cylinders (4) are distributed uniformly above the locking ring (5), and eight notches are distributed uniformly on the locking ring.

* * * * *